United States Patent [19]

Howze et al.

[11] 4,390,078

[45] Jun. 28, 1983

[54] LOUDSPEAKER HORN

[75] Inventors: Bruce Howze, Springfield; Clifford Henrickson, Wallingford, both of Pa.

[73] Assignee: Community Light & Sound, Inc., Philadelphia, Pa.

[21] Appl. No.: 351,439

[22] Filed: Feb. 23, 1982

[51] Int. Cl.[3] ..... G10K 11/00

[52] U.S. Cl. ..... 181/185; 181/188; 181/190; 181/192

[58] Field of Search ..... 181/185, 187, 188, 190, 181/191, 192, 195, 196, 199

[56] References Cited

U.S. PATENT DOCUMENTS

| | | | |
|---|---|---|---|
| 2,537,141 | 1/1951 | Klipsch | 181/187 |
| 2,690,231 | 9/1954 | Levy et al. | 181/192 |
| 4,071,112 | 1/1978 | Keele, Jr. | 181/187 |
| 4,091,891 | 5/1978 | Hino et al. | 181/185 |
| 4,187,926 | 2/1980 | Henricksen et al. | 181/192 |

*Primary Examiner*—Benjamin R. Fuller
*Attorney, Agent, or Firm*—Steele, Gould & Fried

[57] ABSTRACT

A loudspeaker horn which provides constant coverage angles in both the horizontal and vertical planes and affords proper driver loading and a smooth impedance curve down to the lowest frequencies of operation. The throat entrance of the horn is round, to match the driver exit hole, and the throat section expands exponentially, with substantially straight and divergent top and bottom walls and curved side walls. The throat section joins to a transition section in which the side walls expand outward at a more rapid rate and a central vane is introduced top to bottom that both maintains an exponential flare rate and divides the transition section into two vertical slits. The length and width of the transition section are determined by the upper limits of the frequency range and the horizontal coverage angle. The transition section joins to the wave guide section which has a substantially planar side walls forming a conical expansion wave guide with side angle equal to the coverage angles of the horn. The vertical vane extends into the wave guide section, and the dimension of the vane, transition section and wave guide section are selected so that the exponential expansion is maintained until the point at which the conical expansion rate is slower, at which point the conical wave guide is introduced. The final portion of the mouth may be flared at a more rapid rate to overcome beaming near the lower limit of the horn's range. This more rapid flare section may be constructed as an additional mouth extension so that it may be removed when the horn is used in multiple arrays.

10 Claims, 3 Drawing Figures

LOUDSPEAKER HORN

BACKGROUND OF THE INVENTION

1. Field of the Invention

This application relates to loudspeaker horns, particularly horns for the projection of midrange and high frequency sound as produced by an electroacoustical driving mechanism.

2. Prior Art

The two basic functions of loudspeaker horns are to provide proper loading for the driving mechanism, so that its vibrating diaphragm is primarily working against an acoustical load rather than simply its own stiffness and mass, and to provide control of the radiated sound over a uniform coverage angle at all frequencies of operation. These two functions tend to be at odds with each other—horns which provide optimum load have coverage angles that vary with frequency, and prior art horns that provide constant coverage fail to provide proper driver loading, particularly in the lower ranges of operation, as indicated by impedance curves exhibiting substantial ringing in the quoted operating range.

Early horns that addressed the problem of pattern control were primarily of the multicellular or radial type. Both incorporated exponential expansion rates and thus provide good driver loading at lower frequencies. Multicellular horns suffer directivity problems at both the upper and lower extremes of their range. At lower frequencies the entire horn tends to beam, that is, the pattern narrows, particularly in the horizontal plane. At high frequencies the cells beam individually, causing severe lobing in the coverage pattern. Radial horns usually maintain good horizontal coverage but have vertical angles that vary directly with frequency, becoming very narrow at high frequencies. The horn described in U.S. Pat. No. 2,537,141 employs multiple vanes to provide improved pattern control in the radial design. The horn described in U.S. Pat. No. 4,070,112 is also of basically radial design, but employs exponential and conical flares to improve dispersion uniformity; this is the first of the modern constant directivity horns.

The horn described in U.S. Pat. No. 4,187,926 is constructed entirely of planar walls and does not employ any conventional flare expansion rate. Its directional characteristics are good, but low frequency loading of the driver is poor, similar to that of a conical horn. *Acoustical Engineering,* A text book by H. F. Olson (D. Van Nostrand Co., Inc., Princeton, N.J. 1957) illustrates on Page 105 the throat acoustical resistance of horns employing various expansion rates but having the same mouth and throat dimensions. From this illustration and the accompanying text it can be seen that a horn with conical expansion provides throat resistance or driver loading that is substantially poorer than that of an equivalent exponential horn over the lower three octaves of the operating range. This deficiency manifests itself in an electrical impedance curve with substantial peaks and ringing in the lower ranges, indicating that the diaphragm of the driver mechanism is unloaded and going through abnormally long excursions. Such a condition reduces the level and uniformity of the sound output while leading to mechanical failure of the driver mechanism due to the lone excursions.

It is an object of this invention to provide both constant coverage angle and the driver loading of an exponential expansion rate.

BRIEF DESCRIPTION OF THE DRAWINGS

For the purpose of illustrating the invention, there are shown in the drawings forms which are presently preferred, it being understood, however, that this invention is not limited to the precise arrangements and instrumentalities shown.

DETAILED DESCRIPTION OF THE PREFERRED EMBODIMENT

Figure 1:
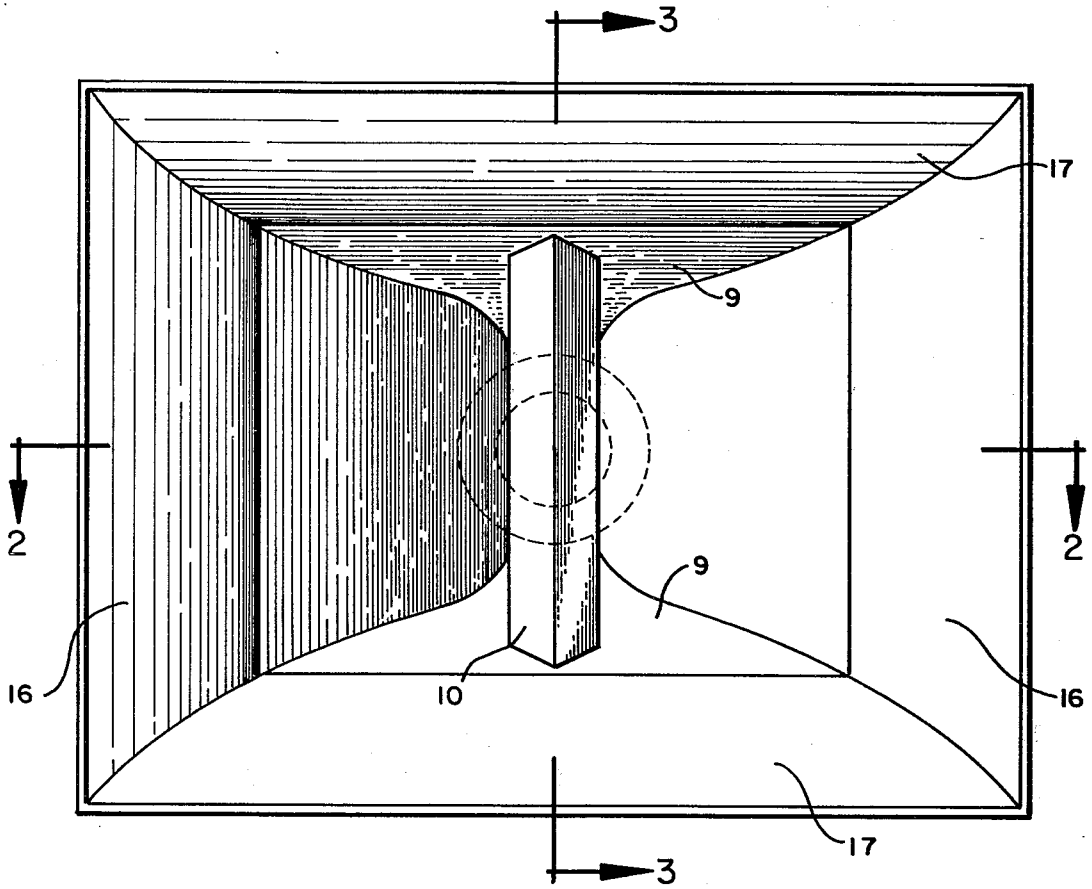
FIG. 1 is a front elevation of a loudspeaker horn according to this invention.
Figure 2:
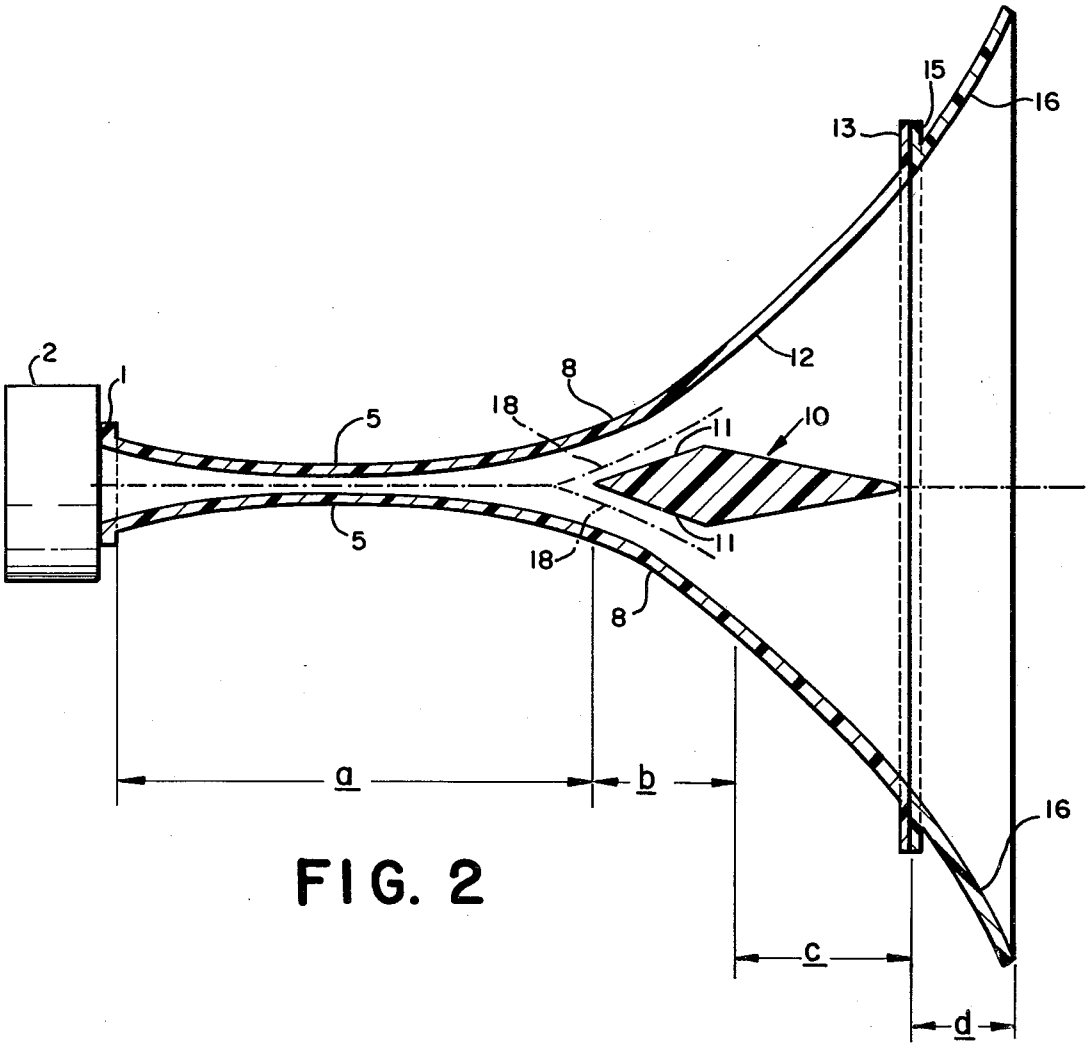
FIG. 2 is a section view taken along the line 2—2 in FIG. 1.
Figure 3:
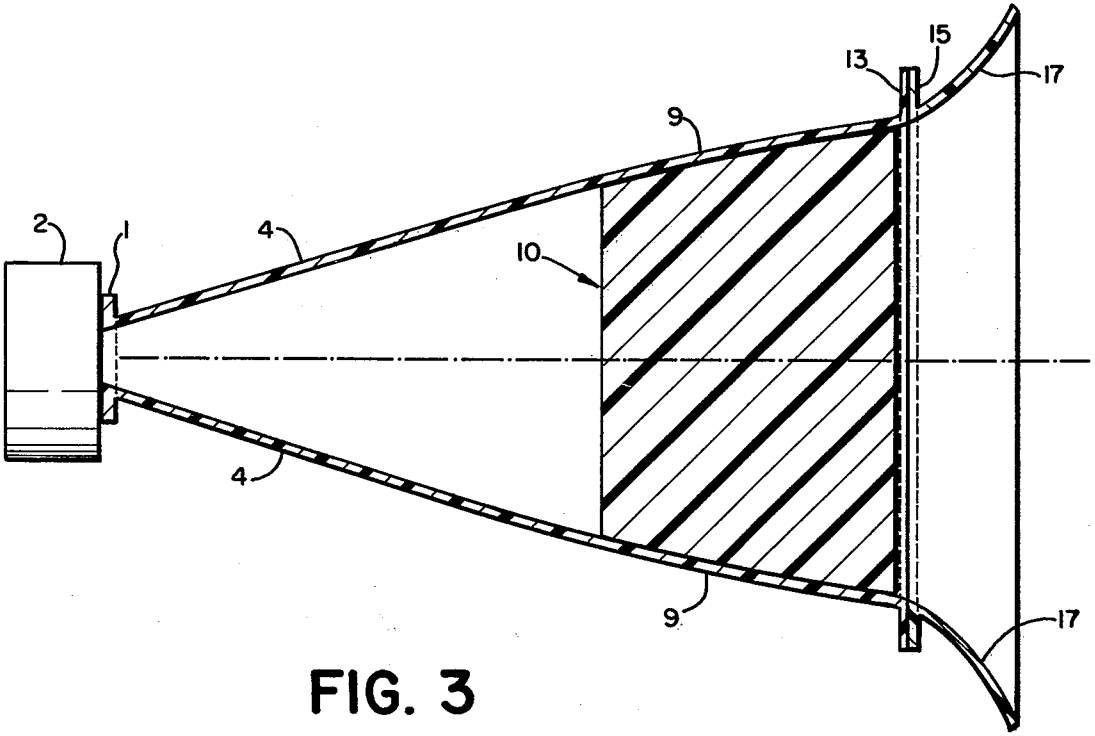
FIG. 3 is a section view taken along the line 3—3 in FIG. 1.

A loudspeaker horn according to this invention is shown in the drawings. Referring to FIGS. 1–3 together, the loudspeaker horn comprises a mounting flange 1 for a typical electro-acoustical driver 2. The entrance hole in the flange 1 is round, to match the exit hole of the driver 2. The round entrance hole is smoothly blended to a rectangular cross-section within the first 10% of the throat length a. The throat section a continues through the balance of its length with a rectangular cross-section formed by the divergent top and bottom walls 4 and the curved side walls 5. The top and bottom walls 4 are substantially straight and planar, except that they may be curved inward toward the central axis near the end of the throat section 3 to blend smoothly to the less divergent top and bottom walls 9 of the transition section b and the wave-guide section c. In the presently preferred embodiment, the throat, transition and wave-guide sections are integrally formed from a rigid moldable material such as fiberglass. At the joining of the throat section a and the transition section b the cross-section of the loudspeaker horn is rectangular, with its horizontal dimension several times smaller than its vertical dimension. In the transition section b the side walls 8 are curved outward more rapidly than in the throat section a and a central vane 10 is introduced extending top to bottom and joined to the top and bottom walls 9 of the transition section b and the wave-guide section c. The central vane may be made from a rigid polymeric material, such as urethane foam. The side walls 11 of the vane 10 diverge outward in the transition area, so that the cross-section of the horn at the joining of the transition section b and the wave-guide section c is two vertical rectangular slots formed by the side walls 11 of the bottom vane 10, the side walls (8, and 12) of the horn, and the top and bottom walls 9 of the horn. In the wave-guide section c the side walls 12 become straight and are angled outward at the desired horizontal coverage of the horn. The vane 10 continues into the wave-guide section c where its side walls 11 are curved inward so that they meet near the end of the wave-guide section c. The top and bottom walls 9 of the wave-guide section c are planar and diverge at the same angle as they do in the transition section b. This angle is the desired vertical coverage angle of the horn. The wave-guide section c terminates in a flange 13 to which the mouth section d may removably attached by being bolted to a similar flange 15 of the mouth section. Alternatively, the mouth section may be integrally formed together with the throat, transition and wave-guide section. The cross-section of the horn at the termination of the wave-guide section c is rectangular, with its horizontal and vertical dimensions of similar, if not identical, proportions. The mouth section d has side walls 16 and top and bottom walls 17 which are curved and flare outward at a more rapid rate than the respective side walls 12 and top and bottom walls 9 of the wave-guide section c. The mouth section d terminates in a rectangular cross-section whose area is two to four times that of the cross-section of the termination of the wave-guide section c.

The loudspeaker horn of the present invention has its dimensions and expansion rates chosen to effect the coverage angle and frequency range desired. The expansion rate of the throat section a is exponential, with a cut-off frequency no greater than 80% of the lowest frequency of horn operation. This expansion rate is accomplished by curving the side walls 5, the top and bottom walls 4 being substantially straight and divergent. The transition section b also expands at an exponential rate, with a cut-off frequency no greater than the lowest frequency of horn operation. The expansion in the transition section b is accomplished by curving the side walls 8 of the horn as well as the side walls 11 of the vane 10. The top and bottom walls 9 of the transition section b and the wave-guide section c are planar and diverge at the vertical coverage angle of the horn. The angle formed between the top and bottom walls of the throat section a and the top and bottom walls of the transition section b and the wave-guide c sections should not be less than 160° or greater than 180° for the proper dispersion control. Making this angle less than 180° facilitates a shorter throat section a and thus a more compact horn. The central axes 18 of the two air channels formed by the side walls 8 of the transition section b and the side walls 11 of the vane 10 diverge from one another at an angle equal to one half the desired horizontal coverage angle of the horn. The length of the transition section b measured along either of these central axes 18 must be equal to or longer than one wave length at the highest frequency of operation. The horizontal width of either of the air channels measured perpendicular to the central axis 18 of the channel must be no greater than two wave-lengths at the highest frequency of operation, if the horn is to have 90° horizontal dispersion. This dispersion varies inversely with the horizontal coverage angle. In the wave-guide section c the side walls 12 and the top and bottom walls 9 are planar and divergent at angles equal to the horizontal and vertical coverage angle respectively. The expansion in the wave-guide is conical. The dimensions at the joining of the transition b and wave-guide section c must be such that the rate of conical expansion be equal to or slower than the exponential rate in the transition section b to insure that the introduction of the conical expansion will have no detrimental effect on the low frequency loading of the driver mechanism or the low frequency performance of the horn. The perimeter of the wave-guide section c at the joint to the mouth section d should equal or exceed one and one half wavelengths at the lowest frequency of operation. The mouth section d has curved side walls (16, 17) which flare more rapidly than the respective sidewalls of the wave-guide section c. The purpose of the mouth section d is to provide greater mouth area for improved low frequency loading and pattern control when the loudspeaker horn is operated as an isolated element. When the horn is operated in an array of several horns of similar type, the mouth section may be removed to facilitate a more compact arrangement of the horn cluster. The mouths of the adjacent horns couple together acoustically at low frequencies and perform the function of a larger mouth.

By employing an exponential expansion rate until such point down the length of the horn where the conical wave-guide represents an equal or slower expansion and only from that point onward introducing the conical wave-guide, this invention provides the low frequency loading of an exponential horn and the directivity control of a conical horn.

The present invention may be embodied in other specific forms without departing from the spirit or essential attributes thereof, and accordingly, references should be made to the appended claims, rather than to the foregoing specification as indicating the scope of the invention.

We claim:

1. A loudspeaker horn for use with an electro-acoustical driver, the horn comprising:

a throat section joined to the driver and having an entrance aperture matched to the driver, the throat section then blending to a rectangular cross-section having top and bottom walls which are substantially planar and diverge at a first angle and having side walls which are curved to maintain an exponential expansion rate of cross-section;

a transition section joined to the throat section and having substantially planar top and bottom walls that diverge at a second angle and having curving side walls;

a central vane having a leading portion extending from the top wall of the transition section to the bottom wall thereof, forming two air channels which expand in cross-section at an exponential rate and diverge from one another at a third angle, the air channels having a rectangular cross-section, the horizontal dimension thereof being substantially smaller than the vertical dimension; and, a wave-guide section joined to the air channels of the transition section, having planar top and bottom walls that diverge at the second angle and having said walls that are planar, blend smoothly with the side walls of the transition section and diverge outwardly at a fourth angle such that the conical expansion of the wave-guide section is nowhere more rapid than the exponential expansion rate of the transition section, a continuation and termination portion of the vertical vane being disposed in the transition section, rejoining the two air channels into one air channel of rectangular cross-section, whereby the loudspeaker horn projects acoustical energy over a substantially constant coverage angle and over a wide frequency range, properly loading the driver at all operating frequencies.

2. The loudspeaker horn of claim 1, further comprising a mouth section removably joined to the wave-guide section, having side, top and bottom walls that flare outwardly at a more rapid rate than those of the wave-guide section, terminating in a rectangular cross-section.

3. The loudspeaker horn of claims 1 or 2, wherein the first and second angles are the same.

4. The loudspeaker horn of claims 1 or 2, wherein the expansion rate of the throat section is hyperbolic.

5. The loudspeaker horn of claims 1 or 2, wherein the expansion rate of the transition section is hyperbolic.

6. The loudspeaker horn of claim 2, wherein the mouth section is permanently joined to the horn.

7. The loudspeaker horn of claim 2, wherein the mouth section flares more rapidly than the wave-guide section in one plane only, forming a direct continuation of the wave-guide walls in the other plane.

8. The loudspeaker horn of claim 2, wherein the walls of the mouth section are planar.

9. The loudspeaker horn of claim 1, wherein the throat section, transition section and wave-guide section are integrally formed.

10. The loudspeaker horn of claim 2, wherein the throat section transition section, wave-guide section and mouth section are integrally formed.

* * * * *